United States Patent [19]

Burnett, Jr. et al.

[11] 4,046,651

[45] Sept. 6, 1977

[54] ELECTROLYTIC HYDRODIMERIZATION PROCESS IMPROVEMENT

[75] Inventors: Joseph C. Burnett, Jr.; John J. Hicks; Leonard L. Hovey, all of Pensacola, Fla.

[73] Assignee: Monsanto Company, St. Louis, Mo.

[21] Appl. No.: 599,908

[22] Filed: July 28, 1975

[51] Int. Cl.[2] ..... C25B 3/10

[52] U.S. Cl. ..... 204/73 R; 204/73 A

[58] Field of Search ..... 204/73 R, 73 A, 72

[56] References Cited

U.S. PATENT DOCUMENTS

| | | | |
|---|---|---|---|
| 3,193,480 | 7/1965 | Baizer et al. | 204/73 A |
| 3,689,382 | 9/1972 | Fox et al. | 204/73 A |
| 3,830,712 | 8/1974 | Campbell et al. | 204/73 A |
| 3,898,140 | 8/1975 | Lester et al. | 204/73 A |

*Primary Examiner*—F.C. Edmundson

*Attorney, Agent, or Firm*—Thomas Y. Awalt, Jr.

[57] ABSTRACT

In a process for hydrodimerizing an olefinic nitrile, amide or ester by electrolyzing an aqueous solution of the olefinic starting material, conductive salt and a nitrilocarboxylic acid compound that inhibits formation of hydrogen at the cathode, such hydrogen formation can be even further inhibited and the current efficiency of the process significantly further increased by including in the solution a tri($C_2$–$C_4$ alkanol)amine such as triethanolamine.

10 Claims, No Drawings

ELECTROLYTIC HYDRODIMERIZATION PROCESS IMPROVEMENT

BACKGROUND OF THE INVENTION

In U.S. Pat. No. 3,898,140, the disclosure of which is incorporated herein by reference, it is disclosed that in a process for hydrodimerizing an olefinic nitrile, amide or ester by electrolyzing an aqueous solution containing the olefinic starting material and a conductive salt, formation of molecular hydrogen at the cathode can be substantially inhibited and the current efficiency of the process can be significantly increased by including in the solution a nitrilocarboxylic acid compound such as, for example, a salt of ethylenediaminetetraacetic acid or N-hydroxyethylethylenediaminetriacetic acid. Although the process improvements described in U.S. Pat. No. 3,898,140 are an important advance in the art, even further improvements whereby such hydrogen formation can be even more fully inhibited and the current efficiency of the process can be even further increased are manifestly highly desirable, and it is an object of this invention to provide such further process improvements. Additional objects of this invention will be apparent from the following description and examples in which all percentages are by weight except where otherwise noted.

SUMMARY OF THE INVENION

It has now been discovered that in a process for hydrodimerizing an olefinic compound having the formula $R_2C{=}CR{-}X$ wherein —X is —CN, $-CONR_2$ or —COOR', R is hydrogen or R', R' is $C_1$—$C_4$ alkyl and at least one R directly attached to either of the two carbon atoms joined by the double bond in said formula is hydrogen by electrolyzing an aqueous solution having dissolved therein said olefinic compound, at least one conductive salt and between about 0.1 and about 50 millimoles per liter of a nitrilocarboxylic acid compound having the formula $Y_2N(Z{-}YN)_nR''COOM$ wherein Y is hydrogen, —R''COOM, $(CH_2)_{m+f}OH$ or $C_1$–$C_{20}$ alkyl; —R''—is $(CH_2)_mCOOM$ or $C_1$–$C_8$ alkyl, hydroxyalkyl or hydroxyphenyl; Z is a divalent $C_2$–$C_6$ hydrocarbon radical; M is hydrogen, alkali metal or ammonium; m is 1 or 2; n is an integer from 0 to 4 and at least one Y is —R''—COOM or $(CH_2)_{m+f}OH$ in contact with a cathodic surface having a cathode potential sufficient for hydrodimerization of said olefinic compound, formation of molecular hydrogen at the cathodic surface can be substantially further inhibited and the current efficiency of the process significantly further increased by including in the solution at least one tri($C_2$–$C_4$ alkanol) amine such as, for example, triethanolamine.

DETAILED DESCRIPTION OF THE INVENTION

Olefinic compounds that can be hydrodimerized by the improved process of this invention and the products of hydrodimerization of such compounds are described in U.S. Pat. No. 3,898,140. Presently of greatest utility in the process of this invention are those olefinic compounds wherein R in the foregoing formula is methyl or ethyl, and particularly acrylonitrile, methylacrylate and alpha-methyl acrylonitrile. The conductive salts, nitrilocarboxylic acid compounds and quaternary ammonium or phosphonium cations that may be employed in the process of this invention are likewise described in U.S. Pat. No. 3,898,140.

Although the process improvement of this invention can be advantageously employed in combination with any of the conductive salt concentrations described in U.S. Pat. No. 3,898,140, it is particularly attractively used in combination with relatively high dissolved conductive salt concentrations (e.g. 15–25%) and the resultingly lower saturation concentrations of the olefinic starting materials and their hydrodimerization products in the aforementioned aqueous solutions (e.g., 1–2% of acrylonitrile and its hydrodimerization product, adiponitrile) with which the problems of molecular hydrogen formation at the cathodic surface and attendant lowering of process current efficiency are normally somewhat more pronounced.

The tri($C_2$–$C_4$ alkanol)amines that are employed in this invention may be any tertiary amines in which a singular nitrogen atom has three $C_2$–$C_4$ alkanol substituents containing like or unlike numbers of carbon atoms and preferably having the hydroxy group directly attached to the terminal carbon atom of each such substituent, e.g., a tripropanolamine, tributanolamine, propanoldiethanolamine or, presently most preferred, triethanolamine (otherwise identified as $\beta$, $\beta'$, $\beta''$-trihydroxytriethylamine) which can be prepared by reaction of ethylene oxide and ammonia. Others of the aforementioned tri($C_2$–$C_4$ alkanol)amines can be prepared by catalytic hydrogenation (e.g., in the presence of nickel on kieselguhr between 50° and 90° C. under pressure) of one or a mixture of several cyanohydrins having the formula $HO(CH_2)_pCN$ wherein $p$ is 1, 2 or 3.

The proportions in which such trialkanolamines are suitably included in the aqueous solution electrolyzed in accordance with the present invention include any concentrations thereof which result in a measurable further inhibiting of hydrogen formation at the cathodic surface, and a generally between about 0.1 and about 50 millimoles of the trialkanolamine per liter of the solution. Even more typically the concentrations employed are between about 0.2 and about 10 millimoles of the trialkanolamine per liter of the aqueous solution.

In many preferred embodiments of this invention, the conductive salt is an alkali metal phosphate, borate, carbonate, or sulfate. In other preferred embodiments, the nitrilocarboxylic acid compound is selected from the group consisting of ethylenediaminetetraacetic acid, N-hydroxyethylethylenediaminetriacetic acid, diethylenetriaminepentaacetic acid, nitrilotriacetic acid, N,N-di(2-hydroxyethyl)glycine and the alkali metal and ammonium salts of such acids. In a particularly preferred embodiment of the invention, the olefinic compound is acrylonitrile, the solution has dissolved therein at least about $10^{-5}$ gram mol per liter of quaternary ammonium or phosphonium ions, and the solution is electrolyzed in an electrolysis medium consisting essentially of said aqueous solution and up to about 20% by weight of an undissolved but preferably dispersed organic phase.

Although the present invention is advantageously useful under any of the process conditions described in U.S. Pat. No. 3,898,140, it is especially desirably employed when the pH of the bulk of the aqueous solution undergoing electrolysis is essentially always greater than 7, such as is typically desirable when the process is carried out in an undivided cell having a heavy metal (e.g., iron, steel or the like) anode in contact with the aqueous solution.

The following specific examples of the process improvement of this invention are included for purposes of illustration only and do not imply any limitations on the scope of the invention. Also in these examples, acrylonitrile and adiponitrile are generally represented as AN and ADN, respectively.

EXAMPLE I

In a continuous process, a liquid electrolysis medium composed between 83 and 88% by (1) an aqueous solution having dissolved therein between 1.3 and 1.8% AN, about 1.2% ADN, 9-10% of a mixture of sodium orthophosphates imparting a pH of 8.6 to the solution, 1.7-2.1 $\times 10^{-3}$ mole per liter of ethyltributylammonium (ETBA) ions, about 0.6 millimoles per liter (80 ppm) of triethanolamine, 17 millimoles per liter (0.6%) of tetrasodium ethylenediaminetetraacetate ($Na_4EDTA$) and the borates produced by adding orthoboric acid in an amount equal to 2.1-2.8% of the solution, and between 12 and 17% by (2) a dispersed but undissolved organic phase containing 24-32% AN, 52-60% ADN, 7-9% AN dimerization byproducts and 8% water was circulated at 52-53° C. and 1.2 meters per second through an undivided electrolytic cell having an AISI 1020 carbon steel anode separated by a gap of 2.25 millimeters from a cathode composed of cadmium conforming to ASTM Designation B440-66T (at least 99.9% Cd) and electroyzed as it passed through the cell with a current density of 0.18 amp/cm$^2$ of the surface of the cathode. Organic phase containing product ADN, byproducts and unreacted AN was separated by decantation from the electrolyzed medium and make-up AN was added after which the medium was recirculated through the cell and electrolyzed again under the conditions just described. For each Faraday of current passed through the medium, 0.2 millimole of triethanolamine and 0.4 millimole of $Na_4EDTA$ were added to the circulating medium and about 10 grams of the solution were purged from the system and replaced with water containing sufficient dissolved ETBA ions and sodium orthophosphates and borates to maintain the concentrations of those constituents of the solution at the aforedescribed levels and the total volume of the medium essentially constant. After 272 hours of electrolysis under those conditions, it was found that AN had been converted to ADN with average and final selectivities of 87.5% and the volume percentage of hydrogen in the offgas had averaged about 1% with a final value of 3%.

COMPARATIVE EXAMPLE A

When the procedure of Example I was repeated except that the use of triethanolamine was omitted, it was found after 268 hours that the average and final ADN selectivities had been again between 87 and 88% but the volume percentage of hydrogen in the offgas had averaged about 6.5% with a final value of 10.4%.

EXAMPLE II

In a continuous process, a liquid electrolysis medium composed about 99% by (1) an aqueous solution having dissolved therein between 0.8 and 1.0% AN, about 0.8% ADN, 18% of a mixture of sodium orthophosphates imparting a pH of 8.5 to the solution, 1.2 $\times 10^{-3}$ mole per liter of ethyltributylammonium (ETBA) ions, about 0.3 millimoles per liter (40 ppm) of triethanolamine, 15.1 millimoles per liter (0.5%) of $Na_4EDTA$ and the borates produced by adding orthoboric acid in an amount equal to about 2% of the solution, and about 1% by (2) a dispersed but undissolved organic phase containing 27-20% AN, 55-59% ADN, 7-8% AN dimerization byproducts and 6-7% water was circulated at 55° C. and 1.2 meters per second through an undivided electrolytic well having an AISI 1020 carbon steel anode separated by a gap of 2.25 millimeters from a cathode composed of cadmium conforming to ASTM Designation B440-66T (at least 99.0% Cd) and electrolyzed as it passed through the cell with a current density of 0.185 amp/cm$^2$ of the surface of the cathode. Organic phase containing product ADN, byproducts and unreacted AN was separated by decantation from the electrolyzed medium and make-up AN was added after which the medium was recirculated through the cell and electrolyzed again under the conditions just described. For each Faraday of current passed through the medium, 0.1 millimole of triethanolamine and 0.4 millimole of $Na_4EDTA$ was added to the circulating medium and 12.5 grams of the solution were purged from the system and replaced with water containing sufficient dissolved ETBA ions and sodium orthophosphates and borates to maintain the concentrations of those consitituents of the solution at the aforedescribed levels and the total volume of the medium essentially constant. After 143 hours of electrolysis under those conditions, it was found that AN had been converted to ADN with average and final selectivities of 88.5% and the volume percentage of hydrogen in the offgas had remained at zero throughout the run.

EXAMPLE III

In a continuous process, a liquid electrolysis medium composed about 99% by (1) an aqueous solution having dissolved therein between 0.6 and 0.9% AN, between 0.5 and 0.8% ADN, 21% of a mixture of sodium orthophosphates imparting to the solution of pH of 8.5, 0.7-1.3 $\times 10^{-3}$ mole per liter of ethyltributylammonium (ETBA) ions, about 0.5 millimoles per liter (67 ppm) of triethanolamine, 15.4 millimoles per liter (0.5%) of $Na_4$-EDTA and the borates produced by adding orthoboric acid in an amount equal to about 2% of the solution, and about 1% by (2) a dispersed but undissolved organic phase containing 30-32% AN, 54-56% ADN, 7% AN dimerization byproducts and 6-7% water was circulted at 55° C. and 1.2 meters per second through an undivided electrolytic cell having an AISI 1020 carbon steel anode separated by a gap of 2.25 millimeters from a cathode composed of cadmium conforming to ASTM Designation B440-66T (at least 99.9% Cd) and electrolyzed as it passed through the cell with a current density of 0.185amp/cm$^2$ of the surface of the cathode. Organic phase containing product ADN, byproducts and unreacted AN was separated by decantation from the electrolyzed medium and make-up AN was added after which the medium was recirculated through the cell and electrolyzed again under the conditions just described. For each Faraday of current passed through the medium, 0.17 millimole of triethanolamine and 0.42 millimole of $Na_4EDTA$ were added to the circulating medium and about 13 grams of the solution were purged from the system and replaced with water containing sufficient dissolved ETBA ions and sodium orthophosphates and borates to maintain the concentrations of those constituents of the solution at the aforedescribed levels and the total volume of the medium essentially constant. After 428 hours of electrolysis under those conditions, it was found that AN had been converted to ADN with average and final selectivities between 88 and 89% and the volume percentage of hydrogen in the offgas had averaged about 1% with a final value of 1.2%.

COMPARATIVE EXAMPLE B

When the procedure of Example III was repeated except that the use of triethanolamine was omitted, it was found after 89 hours that the ADN selectivity had fallen from 89% to 86.4% and the volume percentage of hydrogen in the off-gas had risen to 22.9%.

EXAMPLE IV

In a continuous process, a liquid electrolysis medium composed about 99% by (1) an aqueous solution having dissolved therein about 0.8% AN, 0.6% ADN, 23% of a mixture of potassium orthophosphates imparting to the solution a pH of 8.5, 0.7–1.3 $\times 10^{-3}$ mole per liter of ethyltributylammonium (ETBA) ions, 0.3 millimoles per liter (40 ppm) of triethanolamine, 16 millimoles per liter (0.6%) of tetrapotassium ethylenediaminetetraacetate ($K_4EDTA$) and the borates produced by adding orthoboric acid in an amount equal to about 2% of the solution, and about 1% by (2) a dispersed but undissolved organic phase containing 30–32% AN, 54–56% ADN, 7% AN dimerization byproducts and 6–7% water was circulated at 55° C. and 1.2 meters per second through an undivided electrolytic cell having an AISI carbon steel anode separated by a gap of 2.25 millimeters from a cathode composed of cadmium conforming to ASTM Designation B440-66T (at least 99.9% Cd) and electrolyzed as it passed through the cell with a current density of 0.185 amp/cm$^2$of the surface of the cathode. Organic phase containing product ADN, byproducts and unreacted AN was separated by decantation from the electrolyzed medium and make-up AN was added after which the medium was recirculated through the cell and electrolyzed again under the conditions just described. For each Faraday of current passed through the medium, 0.1 millimole of triethanolamine and 0.29 millimole of $K_4EDTA$ were added to the circulating medium and 12.8 grams of the solution were purged from the system and replaced with water containing sufficient dissolved ETBA ions and potassium orthophosphates and borates to maintain the concentrations of those constituents of the solution at the aforedescribed levels and the total volume of the medium essentially constant. After 146 hours of electrolysis under those conditions, it was found that AN had been converted to ADN with average and final selectivities above 88% and the volume percentage of hydrogen in the offgas had remained at zero throughout the run.

We claim:

1. In a process for hydrodimerizing in an undivided cell an olefinic compound having a formula $R_2C{=}CR{-}X$ wherein —X is —CN, —CONR or —COOR′, R is hydrogen or R′, R′ is $C_1$–$C_4$ alkyl and at least one R directly attached to either of the two carbon atoms joined by the double bond in said formula is hydrogen by electrolyzing an aqueous solution having dissolved therein said olefinic compound, conductive salt selected from the group consisting of alkali metal phosphates, borates, carbonates and sulfates, at least $10^{-3}$ gram mole per liter of a directive salt selected from the group consisting of quaternary ammonium and phosphonium ions and between about 0.1 and about 50 millimoles per liter of a nitrilocarboxylic acid compound having the formula $Y_2N(Z)_nR''COOM$ wherein Y is hydrogen, —R″COOM, $(CH_2)_{m+1}OH$ or $C_1$–$C_{20}$ alkyl; —R″— is $(CH_2)_m$ or (CHR′); R″ is hydroxy, 'COOM, $(CH_2)_mCOOM$ or $C_1$–$C_8$ alkyl, hydroxyalkyl or hydroxyphenyl; Z is a divalent $C_2$–$C_6$ hydrocarbon radical; M is hydrogen, alkali metal or ammonium, *m* is 1 or 2; *n* is an integer from 0 to 4 and at least one Y is —R″COOM or $(CH_2)_{m+1}OH$ in contact with a cathodic surface having a cathode potential sufficient for hydrodimerization of said olefinic compound, the improvement which comprises including in said solution between 0.1 and about 50 millimoles per liter of a tri($C_2$–$C_4$ alkanol)amine.

2. The process of claim 1 wherein the pH of the bulk of the solution is essentially always greater than 7.

3. The process of claim 1 wherein the tri($C_2$–$C_4$ alkanol)amine is triethanolamine.

4. The process of claim 3 wherein there are included in the solution between about 0.2 and about 10 millimoles per liter of triethanolamine.

5. The process of claim 3 wherein the nitrilocarboxylic acid compound is selected from the group consisting of ethylenediaminetetraacetic acid, N-hydroxyethylethylenediaminetriacetic acid, diethylenetriaminepentaacetic acid, nitrilotriacetic acid, N,N-di(2-hydroxyethyl)glycine and the alkali metal and ammonium salts of such acids.

6. The process of claim 5 wherein the pH of the bulk of the solution is essentially always greater than 7.

7. The process of claim 6 wherein the nitrilocarboxylic acid compound is selected from the group consisting of ethylenediaminetetraacetic acid, N-hydroxyethylethylenediaminetriacetic acid and the alkali metal salts of such acids.

8. The process of claim 6 carried out in an undivided cell having a heavy metal anode in contact with said solution.

9. The process of claim 6 wherein the conductive salt is an alkali metal phosphate, borate, carbonate or sulfate.

10. The process of claim 6 wherein the olefinic compound is acrylonitrile, the solution has dissolved therein at least about 10−5 gram mol per liter of quaternary ammonium or phosphonium ions, and the solution is electrolyzed in and electrolysis medium consisting essentially of said aqueous solution and up to about 20% by weight of an undissolved organic phase.

* * * * *